US006739849B1

(12) United States Patent
Hansen et al.

(10) Patent No.: US 6,739,849 B1
(45) Date of Patent: May 25, 2004

(54) MEANS FOR OPTIMIZING THE DISC VALVE IN A GEROTOR MOTOR

(75) Inventors: Kim Rene Hansen, Soenderborg (DK); Claus Johansen, Soenderborg (DK); Rene Andersen, Sydals (DK)

(73) Assignee: Sauer-Danfoss (Nordborg) A/S (DK)

( * ) Notice: Subject to any disclaimer, the term of this patent is extended or adjusted under 35 U.S.C. 154(b) by 0 days.

(21) Appl. No.: 10/339,025

(22) Filed: Jan. 9, 2003

(51) Int. Cl.[7] ..... F03C 2/08
(52) U.S. Cl. ..... 418/61.3
(58) Field of Search ..... 418/61.3

(56) References Cited

U.S. PATENT DOCUMENTS 3,597,128 A * 8/1971 Veneble et al. ..... 418/61.3
3,841,801 A * 10/1974 Sturlason et al. ..... 418/61.3

* cited by examiner

*Primary Examiner*—Thomas Denion

(57) ABSTRACT

A gerotor motor has a housing located adjacent a port plate. The housing has two fluid chambers on opposite sides of a disc valve. The disc valve is in sealing surface engagement with the port plate to prevent fluid from moving between the fluid chambers. The valve assembly has forward and rearward sides and has substantially equal volumes of material removed therefrom so as to balance the port plate against any torsional forces imposed on the valve assembly which might otherwise deflect the valve assembly to interfere with its sealing relationship with the port plate.

6 Claims, 4 Drawing Sheets

MEANS FOR OPTIMIZING THE DISC VALVE IN A GEROTOR MOTOR

BACKGROUND OF THE INVENTION

The disc valve element in a gerotor motor of the disc valve type is pressed against a port plate element. The surface between the disc valve and the port valve forms a sealing surface, so that fluid from high-pressure chambers in the gear set cannot get in touch with fluid from the low-pressure chambers. On the rear of the disc valve is arranged a sealing element, and the surface between the disc valve and the sealing element also forms a sealing surface, so that the high and low pressure chambers do not fluidly connect with each other. The sealing is partly secured by a spring element acting upon the sealing element in the direction of the gear set, partly by accurately adapted areas acted upon by the fluid pressure from high-pressure and low-pressure.

Experience and simulation results show that the disc valve element is slightly deformed when the motor is loaded and the pressure increases. Part of the deformation takes place because of torsional forces around the axis of the valve causing the two sealing surfaces to deform and to fail to maintain their intimate contact. This causes a leakage from the high-pressure chamber to the low-pressure chamber. This leakage contributes to a deterioration of the motor efficiency and is therefore not desirable. The torsional forces around the axis of the valve are avoided when the surface mass of the valve material on the front of the valve (where the commutation slots are located) is equal and symmetrical to the mass of material on the rear of the valve.

It is therefore a principal object of this invention to provide a means for optimizing the disc valve in a gerotor motor.

A further object of the invention is to provide means in a gerotor motor for equalizing torsional forces within a disc valve of the motor to reduce or eliminate distortion and deformation of sealing surfaces in the valves, to overcome fluid leakage.

A still further object of this invention is to impose blind slots in the rear side of the valve of a gerotor motor to balance the torsional forces within the valve to reduce distortion of the sealing surfaces and to decrease the fluid loss caused by such distortion.

These and other objects will be apparent to those skilled in the art.

SUMMARY OF THE INVENTION

A gerotor motor has a housing located adjacent a port plate. The housing has two fluid chambers on opposite sides of a disc valve. The disc valve is in sealing surface engagement with the port plate to prevent fluid from moving between the fluid chambers. The valve assembly has forward and rearward sides and has substantially equal volumes of material removed therefrom so as to balance the disc valve against any torsional forces imposed on the valve assembly which might otherwise deflect the valve assembly to interfere with its sealing relationship with the port plate.

DESCRIPTION OF THE PREFERRED EMBODIMENT

Figure 1:
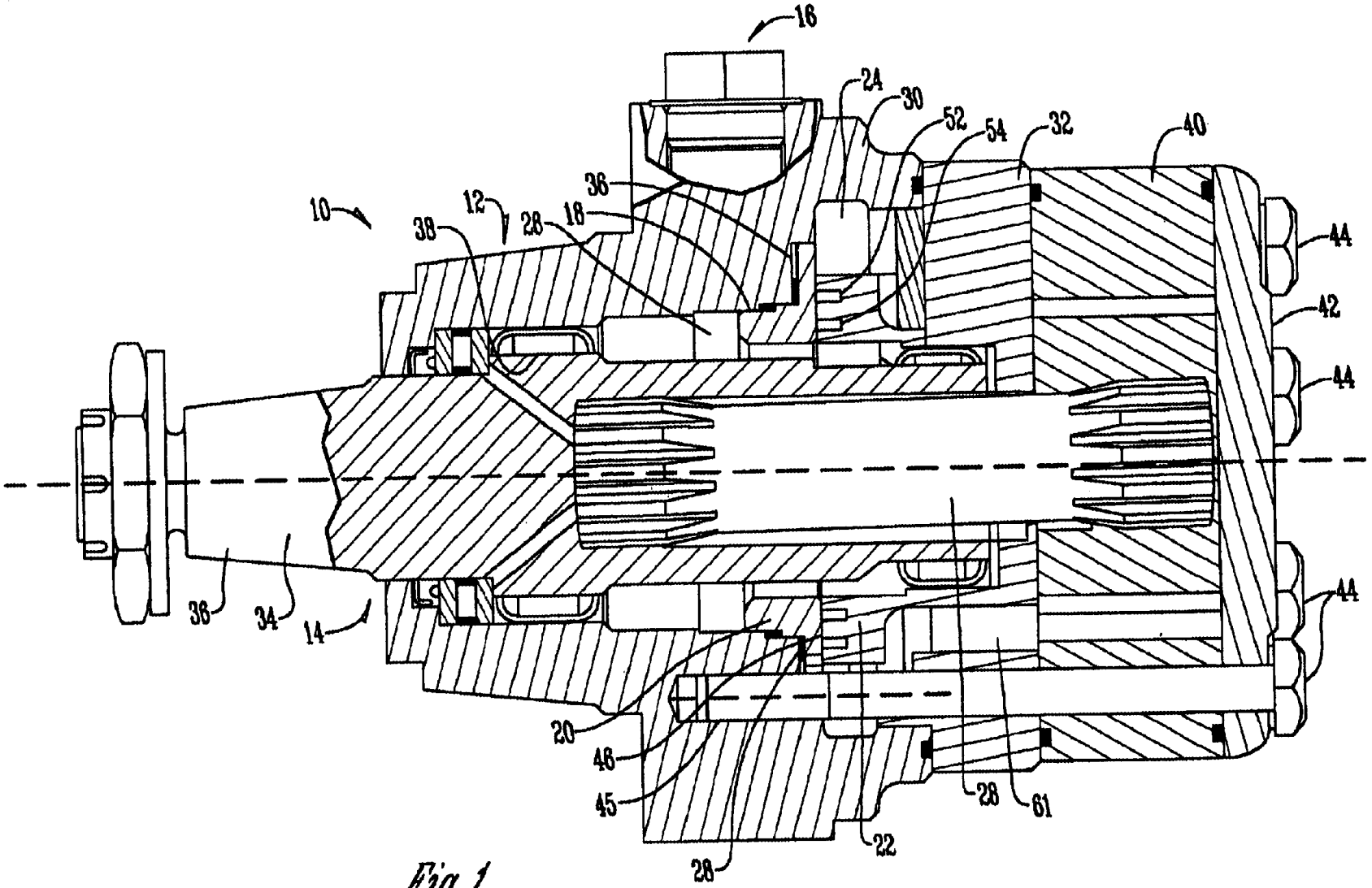
FIG. 1 is a longitudinal sectional view of the gerotor motor of this invention.

FIG. 1 shows a gerotor motor 10 with a housing 12 having a center bore 14. The housing has a typical fluid inlet/outlet port 16. This is a conventional inlet and outlet system known to those skilled in the art and is not considered an inventive feature of this disclosure. Annular cavity 18 within the housing 12 contains a sealing element 20. A disc valve 22 is located within a first chamber 24. A second chamber 26 accommodates spring 28 which bears against sealing element 20 to hold the sealing element in contact with a forward side 46 of the disc valve 22. A shoulder 30 on the inner end of housing 12 engages port plate 32 (FIG. 1). Shaft 34 with an outer end 36 extends through bearing 38 and inwardly through the center bore 14 of the housing 12 to be connected with splines and the like to gear set 40.

Figure 2:
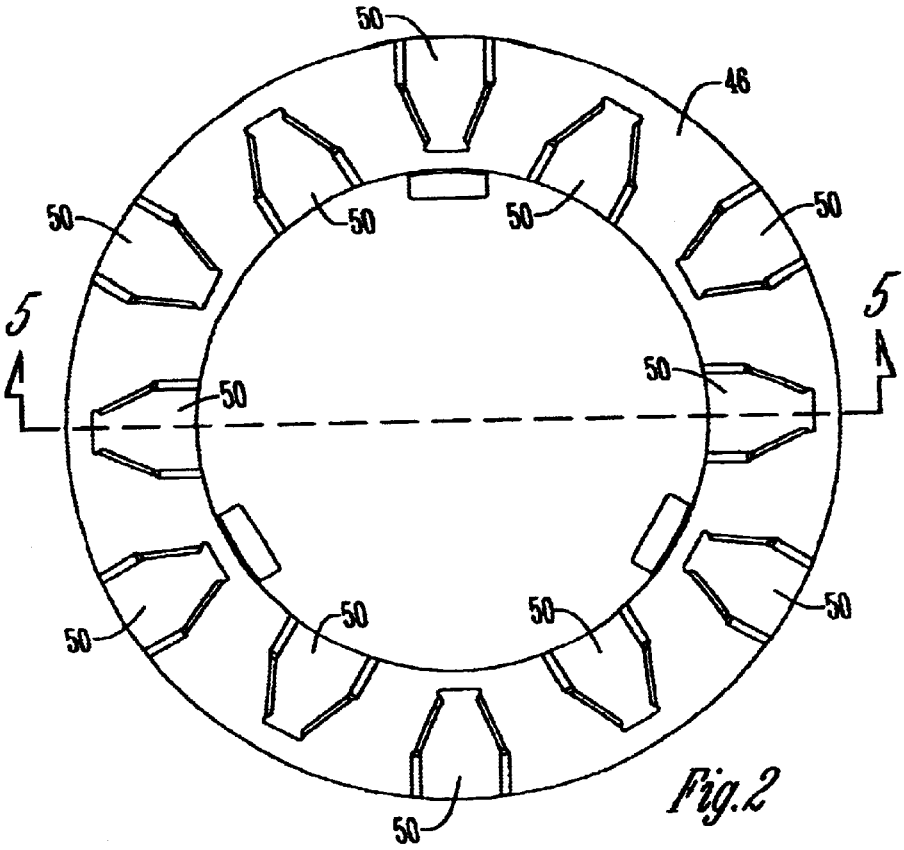
FIG. 2 is an elevational view of the front end of the disc valve.
Figure 3:
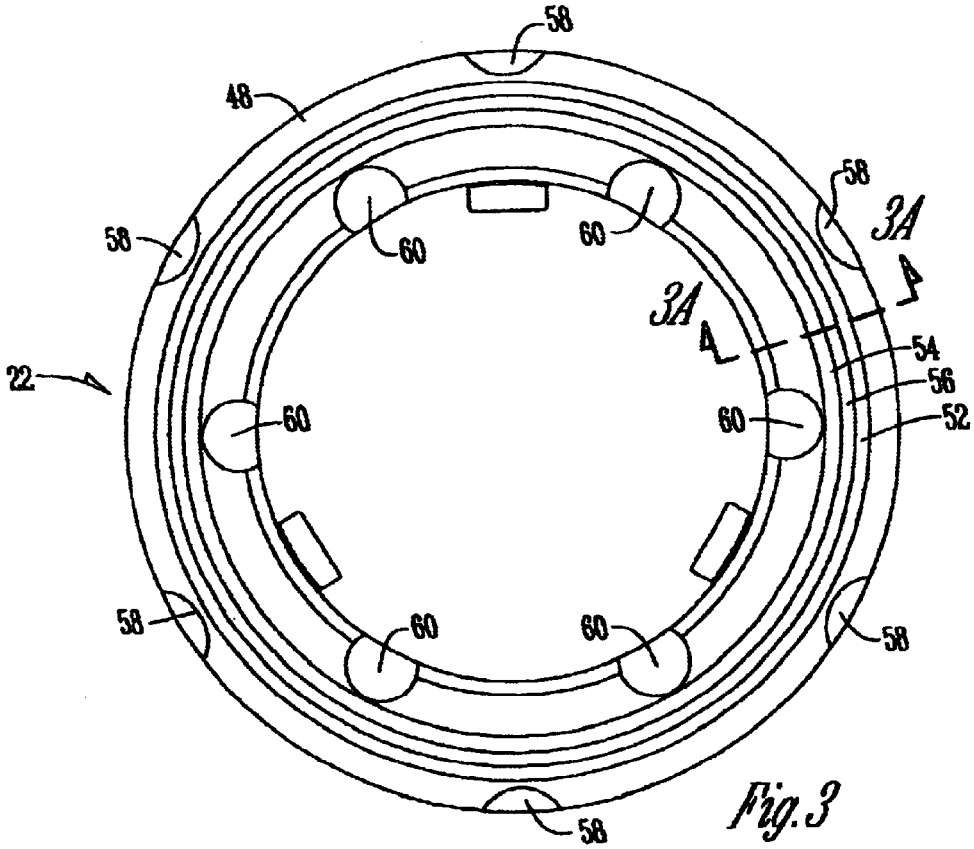
FIG. 3 is a rear elevational view of the disc valve.

End plate 42 is secured to the rearward end of the motor 10 by a plurality of bolts 44 which extend through the end plate 42, gear set 40, port plate 32 and thence into a threaded well 45 in housing 12. As previously indicated, disc valve 22 has a forward side 46 and a rearward side 48 (FIGS. 2 and 3, respectively). Commutation slots 50 are formed in the forward side 46 of the disc valve 22 as best shown in FIG. 2.

Figure 3A:
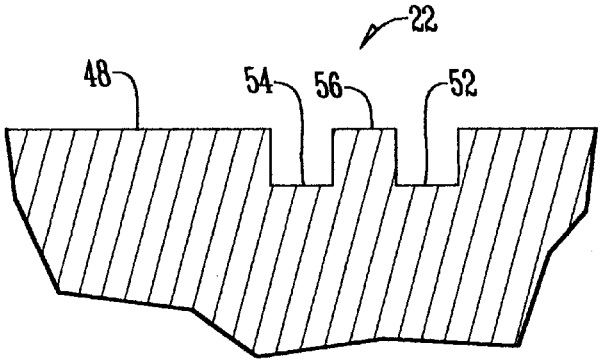
FIG. 3A is an enlarged scale sectional view taken on line 3A—3A of FIG. 3.

Concentric annular grooves 52 and 54 are formed in the rearward side 48 of the disc valve 22 as best shown in FIGS. 3 and 3A. An annular sealing shoulder 56 appears between the outer groove 52 and the inner groove 54. The shoulder 56 serves as the sealing surface against the sealing element 20.

Figure 4:
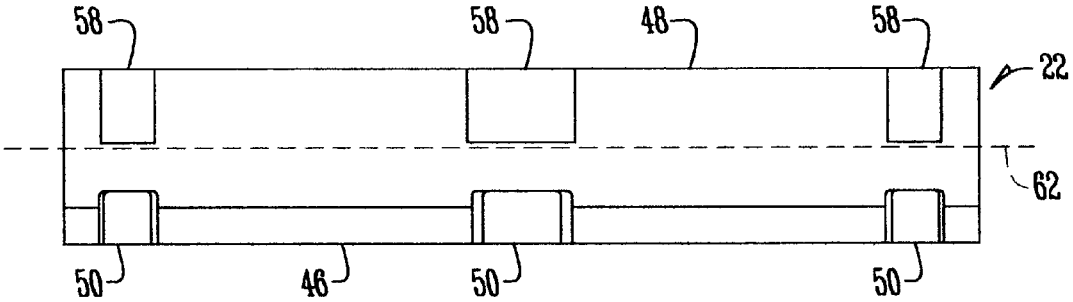
FIG. 4 is a top elevational view of the disc valve.
Figure 5:
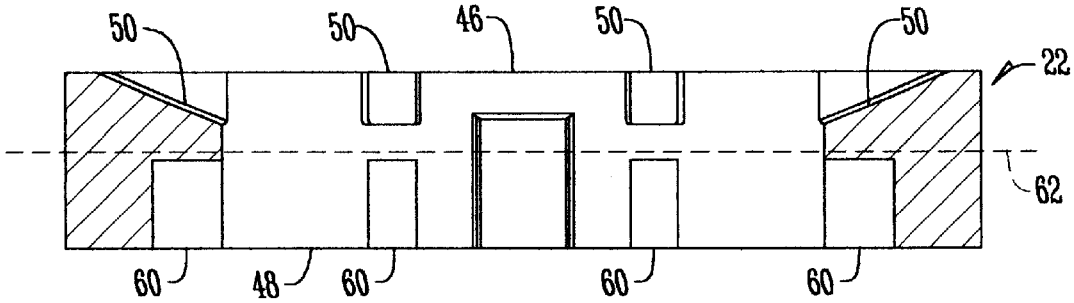
FIG. 5 is a sectional view taken on line 5—5 of FIG. 2.
Figure 6:
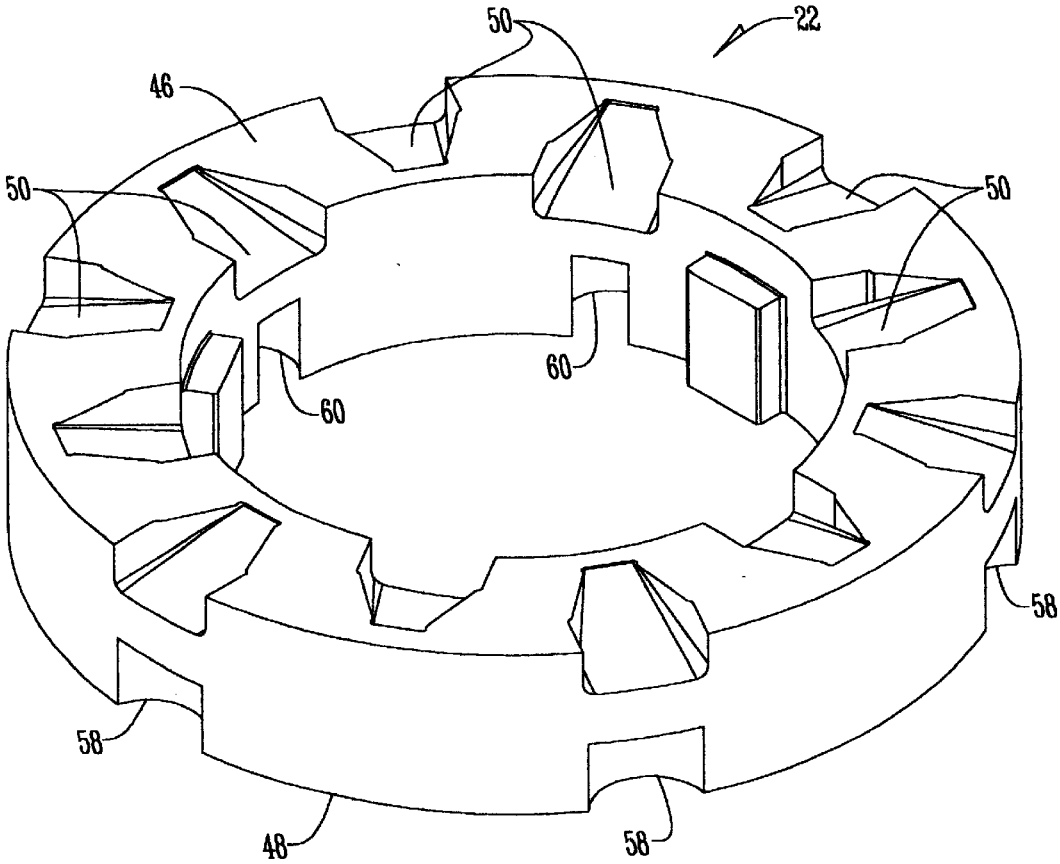
FIG. 6 is a forward perspective view of the disc valve showing the front end thereof.

Blind slots 58 and 60 are formed in the rearward side 48 of disc valve 22 as best shown in FIG. 3. The volume of blind slots 58 and 60 are substantially equal to the volumes of the commutating slots 50 on the other side of the valve disc 22. The location of the blind slots 58 and 60 are shown in the most desired location, although some variation from the location shown in FIG. 3 could be entertained without defeating the use and function of this invention. With reference to FIGS. 4 and 5, the center axis and plane is designated by the numeral 62. The disc valve 22 with the blind slots 58 and 60 will still be deformed when the motor is loaded, but the torsion about the axis 62 will be considerably reduced. This deformation has practically no influence on the tightness, and consequently, the motor efficiency will be improved.

When pressure is applied to the motor inlet/outlet 16, it will tend to deflect the disc element 22 from its symmetrical unloaded position shown in FIGS. 4 and 5 to downwardly or upwardly concave positions of axis 22 (i.e., plane 62) when the torsional forces around the axis 22 caused by high fluid pressure in chamber 24 is present. The torsional forces causing the "bending" of plane 62 will be in an opposite direction when torsional forces around the plane 62 acts on the disc valve 22 when chamber 26 contains the higher fluid pressure.

The two annular grooves 52 and 54 are used in the prior art but they are not used in conjunction with the blind slots 58 and 60 which serve to balance the mass of material on opposite sides of plane 62. The torsional forces around the axis or plane 62 will be reduced because the mass of material of the disc valve is more balanced on opposite sides of the plane 62. Again, this is because of the symmetry of material on opposite sides of the plane 62 afforded by the blind slots 58 and 60, which have a volume substantially equal to the volume of commutating slots 50.

The two annular grooves 52 and 54 on opposite sides of the disc valve 22 do not allow an indiscriminate location of these blind spots to be located. Care must be exercised that the blind slots do not interconnect the grooves 52 and 54.

First and second fluid chambers 24 and 26 are spaced apart from one another in the housing 12 around shaft 34. Fluid is communicated with the gear set 40 through a disc valve 22. The rotating disc valve 22 controls the fluid communication with the fluid chambers 24 and 26 to optimally expand and contract the fluid pressure in the gear set 40. The disc valve 22 has a first surface that engages the port plate 32 to form a first sealing surface and engages a sealing element 20 in the housing 12 to form a second sealing surface. Commutating slots 50 are formed in the first sealing surface and blind slots 58 and 60 are formed in the second surface and balance the mass of material existing on opposite sides of a plane passing through the disc valve 22 in a direction perpendicular to a longitudinal axis of the disc valve 22, to enhance fluid sealing conditions created at the sealing surfaces.

In operation, high pressure fluid enters one of the ports 16 and flows to one of the fluid chambers, e.g. fluid chamber 24 radially outside the disc valve 22. The high pressure fluid in fluid chamber 24 enters the commutating slots 50 which open onto the radial outside of the disc valve and flows through passages 61 in port plate 32 to the high-pressure chambers of gear set 40. High pressure fluid from fluid chamber 24 also enters blind slots 58 in the disc valve 22. Low pressure fluid from the low-pressure chambers of gear set 40 returns through passages 61 to commutating slots 50 which open towards the radial inside of disc valve 22 and flows into the fluid chamber 26. The low pressure fluid in fluid chamber 26 also enters blind slots 60 in the disc valve 22. From the fluid chamber 26 the fluid exits the other port 16.

It is therefore seen that the described blind slots 58 and 60 serve to balance the mass of the disc valve 22 about axis and plane 62, thus reducing the amount of distortion of the disc valve and reducing the amount of leakage that may occur with respect to the sealing engagement of shoulder 56 with the sealing element 20, and with respect to the sealing engagement of forward side 46 with port plate 32. It is thus seen that this invention will achieve at least all of its stated objectives.

We claim:

1. A gerotor motor, comprising, a housing having a center bore aligned with and connected to a port plate, a gear set and end plate with center bores being in the port plate and gear set in axial alignment with the center bore of the housing, an elongated shaft extending through the gear set, the port plate and the housing and extending outwardly from the housing, first and second spaced fluid chambers in the housing around the shaft, a disc valve assembly on the shaft and having a surface engaging the port plate to form a sealing surface to prevent the passage of fluid between the fluid chambers of the housing, a sealing element between the first chamber in the housing and the disc valve assembly to prevent the passage of fluid between the fluid chambers in the housing, commutation slots formed in a forward end of the disc valve assembly, and blind slots formed on the rearward end of the disc valve assembly to balance the mass of material existing on opposite sides of a plane passing through the valve assembly in a direction perpendicular to the longitudinal axis of the shaft to retard any deflection of the disc valve assembly which might otherwise interfere with the sealing relationship between the disc valve assembly and the port plate.

2. The motor of claim 1 wherein said blind slots have a volume similar to that of the commutation slots.

3. The motor of claim 1 wherein a spring element is located adjacent the sealing element to urge the sealing element in a direction towards the disc valve.

4. The motor of claim 1 wherein first and second spaced concentric grooves are located on the rearward side of the valve assembly with a concentric sealing shoulder therebetween, with each of the grooves being fluidly connected to one of the chambers in the housing.

5. The motor of claim 4 wherein the blind slots are not in fluid communication with the concentric grooves.

6. An improvement in a gerotor motor having a housing, a gear set in the housing with contracting and expanding fluid chambers formed by an internally rotating member, and where fluid is communicated with the gear set through a disc valve assembly comprising, a port plate, and a rotating disc valve which controls the fluid communication with the fluid chambers to optionally expand and contract the fluid pressure in the chambers, the disc valve assembly comprising, the disc valve having a first surface engaging the port plate to form a first sealing surface, the disc valve engaging a sealing element in the housing to form second sealing surface, commutation slots formed in the first sealing surface;

blind slots formed in the second surface; the blind slots formed to balance the mass of material existing on opposite sides of a plane passing through the disc valve in a direction perpendicular to a longitudinal axis of the disc valve, to enhance fluid sealing conditions created at the sealing surfaces.

* * * * *